United States Patent [19]

Gademann et al.

[11] Patent Number: 4,694,814

[45] Date of Patent: Sep. 22, 1987

[54] IGNITION SYSTEM FOR INTERNAL COMBUSTION ENGINES WITH A MAGNET GENERATOR

[75] Inventors: Lothar Gademann, Rottenburg; Adam Hirt, Ammerndorf; Hartmut Michel, Reutlingen; Hans-Dieter Schmid, Nuremberg; Michael Schneider, Reutlingen, all of Fed. Rep. of Germany

[73] Assignee: Robert Bosch GmbH, Stuttgart, Fed. Rep. of Germany

[21] Appl. No.: 852,806

[22] PCT Filed: Jul. 31, 1985

[86] PCT No.: PCT/DE85/00258

§ 371 Date: Feb. 21, 1986

§ 102(e) Date: Feb. 21, 1986

[87] PCT Pub. No.: WO86/03259

PCT Pub. Date: Jun. 5, 1986

[30] Foreign Application Priority Data

Nov. 30, 1984 [DE] Fed. Rep. of Germany ..... 3443739

[51] Int. Cl.[4] ..... F02P 3/12

[52] U.S. Cl. ..... 123/644; 123/651; 123/418

[58] Field of Search ..... 123/644, 418, 149 C, 123/651, 652; 315/209 T

[56] References Cited

U.S. PATENT DOCUMENTS

| | | | |
|---|---|---|---|
| 4,174,697 | 11/1979 | Podrapsky et al. | 123/651 |
| 4,175,509 | 11/1979 | Orova et al. | 123/418 |
| 4,178,892 | 12/1979 | Podrapsky et al. | 123/418 |
| 4,244,344 | 1/1981 | Werner et al. | 123/644 |
| 4,308,848 | 1/1982 | Pfaff et al. | 123/644 |
| 4,512,303 | 4/1985 | Watanabe | 123/418 |

*Primary Examiner*—Raymond A. Nelli

*Attorney, Agent, or Firm*—Michael J. Striker

[57] ABSTRACT

A control circuit for an ignition system having a magnet generator provides an abrupt adjustment of the ignition time point toward an advanced ignition when a predetermined upper speed range of an engine is reached. The control circuit includes a frequency dependent R-C member coupled to a control switching transistor activated at a preset voltage level to trigger an ignition switching power transistor. The R-C member is preadjusted so as to be charged to the preset voltage level at the time point of the transition from a lower to the upper speed range.

7 Claims, 3 Drawing Figures

IGNITION SYSTEM FOR INTERNAL COMBUSTION ENGINES WITH A MAGNET GENERATOR

STATE OF THE ART

Figure 1:
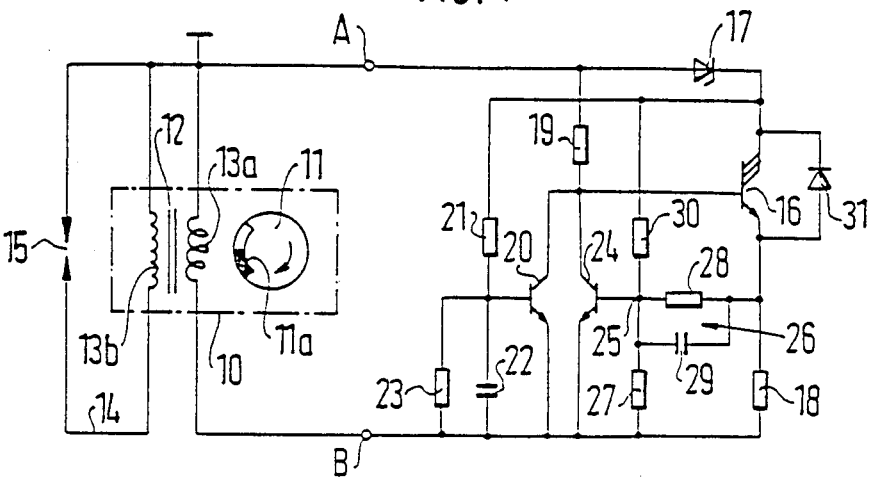

The invention is based on an ignition system for internal combustion engines with a magnet generator. In an ignition system known from U.S. Pat. No. 4,175,509 a second switch branch for the abrupt adjustment of the time point of ignition is provided in addition to a first switch branch, whereby a control switch of the second switch branch switches-over an ignition switch element at the time point of ignition and is connected with a speed dependent resistance or R-C member for adjusting the so-called time ignition jump speed. With this solution it is disadvantageous that with the second switch branch for the abrupt ignition time adjustment the ignition switch element is no longer completely switched-over into the current conducting state before the ignition time point. Consequently, the primary current is alternated and the primary voltage is simultaneously increased. By means of the increased primary voltage the time point of ignition is preset to advanced ignition. However, such an attenuation of the primary current also results in an undesired attenuation of the ignition voltage. Thus, it is also difficult to optimally match the ignition time adjustment characteristic curve to the requirements both in the idle and also in the power output operational range of the engine.

It is an object of the subject invention to improve an ignition system of the aforementioned type in that the adjustment characteristic curve of the time point of ignition is easier to adapt to the operational requirements of the engine whereby for generating a high ignition voltage, a very low attenuation of the primary current over the entire rotary speed range is obtained.

ADVANTAGES OF THE INVENTION

The ignition system in accordance with the invention is advantageous in that the time point of ignition in the lower speed range is determined by the primary voltage before each ignition, while the time point of ignition in the upper speed range is determined by the primary current. Thus, the ignition system can be dimensioned in a simple manner in such a way that the time point of ignition is preadjusted in the direction of early ignition when a defined so-called ignition time jump speed is reached. A further advantage can be seen in that the time ignition adjustment characteristic curve can be still improved, if need be, by additional measures independently of the lower speed range or the upper speed range.

It is particularly advantageous to form the speed dependent R-C member of the second switch branch from a resistor and a parallel arranged capacitor, so that the resistance value of the R-C member decreases with increasing speed. If such an R-C member forms the branch of the voltage divider being connected with the ignition switching element, the potential at the second control switch is increased with increased speed before the time point of ignition.

It is further advantageous for influencing the adjustment characteristic curve of the time point of ignition in the upper speed range, to connect the control electrode of the second control switch through a further resistor with a point of the primary circuit which is not connected to a measuring resistor. For influencing the adjustment characteristic in the lower speed range a third switch branch for switching over the ignition switch element is connected parallel to the first switch branch, whereby two superimposed characteristic curves can be generated by a corresponding dimensioning of the two switch branches, and the desired ignition time point is obtainable even at low idling speeds.

DRAWING

Two exemplified embodiments of the invention are illustrated in the drawings and are explained in detail in the subsequent description.

Figure 2:
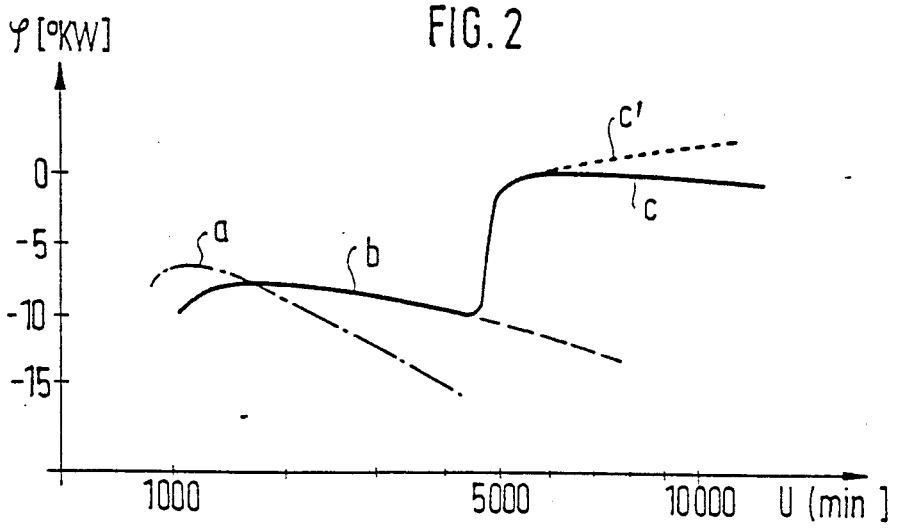
Figure 3:
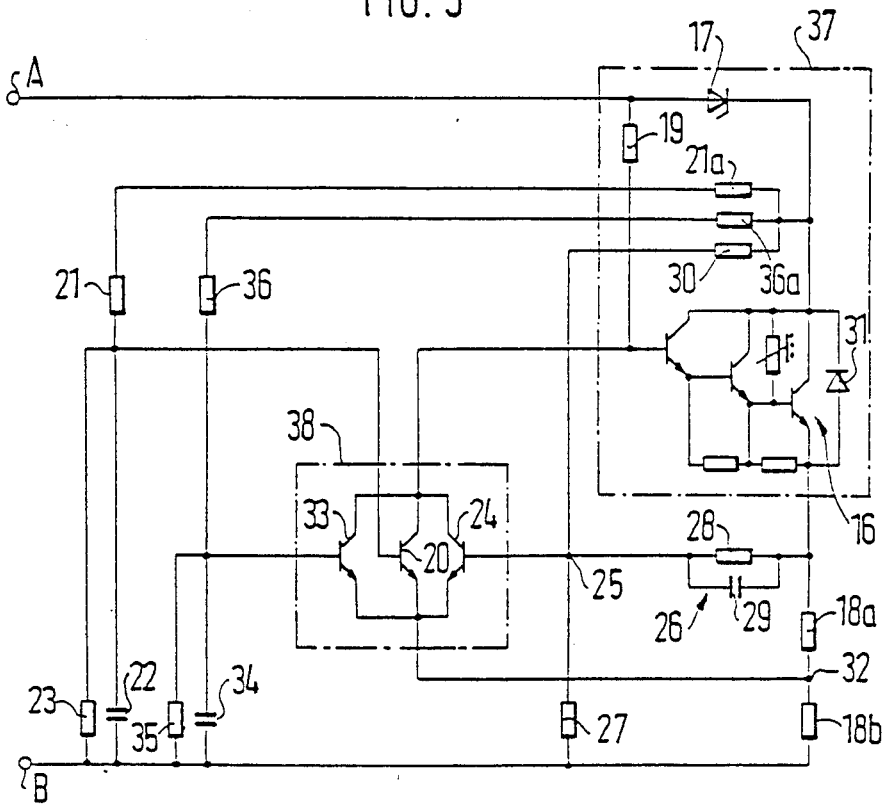

FIG. 1 illustrates the ignition system in accordance with the invention,

FIG. 2 the adjustment characteristics curve of the ignition time point of the ignition system and;

FIG. 3 illustrates a control circuit of the ignition system of FIG. 1 being improved with additional measures

DESCRIPTION OF THE EXEMPLIFIED EMBODIMENTS

FIG. 1 illustrates the circuit diagram of an ignition system fo a one cylinder internal combustion engine which is power supplied by a magnet generator 10. The magnet generator is provided with a rotating magnet system 11 which has a permanent magnet 11*a* disposed between two pole shoes and mounted at the circumference of a fly wheel or fan wheel of the internal combustion engine (not illustrated). The magnet system 11 cooperates with an ignition armature 12 being mounted on the housing of the internal combustion engine and which simultaneously acts as an ignition coil having a primary winding 13*a* and a secondary winding 13*b*. The secondary winding is connected by an ignition cable 14 with a spark plug 15 of the internal combustion engine. The primary winding 13*a* of the ignition armature 12 is connected at connections A,B to a primary current circuit including the switch path of a npn-type ignition transistor 16. The ignition transistor 16 is designed as a triple-Darlington-switch transistor, whose collector is connected via zener diode 17 to grounded connection A of the primary winding 13*a* and whose emitter is connected by a current measuring resistor 18 to connection B leading to the other end of the primary winding 13*a*. The base of the ignition transistor 16 is connected by a resistor 19 with the anode of the zener diode 17, whereby the base potential of the ignition transistor 16 is increased. The zener diode is used for limiting the inverse voltage. The control path of the ignition transistor 16 which is formed by the base-emitter is connected with a control circuit, which is provided with a first switching branch including a first control switch designed as npn-type transistor 20 and is parallel connected to the current measuring resistor 18 disposed in series with the ignition transistor 16. The base of the control transistor 20 is connected by a resistor 21 with the collector of the ignition transistor 16 and by a parallel connection of resistor 23 and capacitor 22 with connection point B.

For the abrupt preadjustment of the ignition time point in the direction of advanced ignition in the upper rotary speed range, the control circuit further includes a second switching branch consisting of a second control switch in the form of a npn transistor 24 whose switching path is connected parallel to that of the first control transistor 20. The second control transistor 24 is disposed with its switch path parallel to the one of the first control transistor 20. The base of the second control transistor 24 is connected with the tap point 25 of a voltage divider 26, 27, which is connected parallel to the current measuring resistor 18. The upper branch of the voltage divider consists of a rotary speed depenedent R-C member 26 and the lower branch of a resistor 27. The speed dependent R-C member 26 is formed by an ohmic resistor 28 and a parallel capacitor 29 disposed between the tap point 25 and the emitter of the ignition transistor 16. A further resistor 30 is connected between the base of the second control transistor 24 and the collector of the ignition transistor 16. Furthermore, an inverse diode 31 is connected parallel to the switching path of the ignition transistor 16.

The mode of operation of the ignition system in accordance with FIG. 1 will be explained in more detail with reference to FIG. 2. FIG. 2 illustrates the course of the ignition time point of the internal combustion engine in degrees of the crankshaft rotation with respect to the upper dead center of the piston versus the rotary speed U of the internal combustion engine. The dash-dotted curve a will be later explained in more detail, since it is only realizeable by the circuit of FIG. 3. The curve b for the lower rotary speed range up to the so-called ignition jump speed of about 4500 rotations per minute will be realized by the first switching branch with the control transistor 20 (FIG. 1). The curve c for the upper rotary speed range is realized by the second switching branch with the second control transistor 24.

During the operation of the internal combustion engine, the rotating magnet system 11 generates positive and negative voltage half waves in the primary winding 13*a* of the ignition armature 12. From the grounded connection A of the primary winding, the positive voltage half waves are attenuated through the inverse diode 31 and the zener diode 17 to such an extent that the voltage peaks do not endanger the remainder of the structural elements of the ignition system. The negative voltage half waves are employed for generating the ignition energy as well as for triggering the ignition. With the start of each negative voltage half wave a control current flows at first through the resistor 19 to the base-emitter control path of the ignition transistor 16 and switches the same into the current conducting state. Now, the primary current can flow through the switching path of the ignition transistor 16 and the current measuring resistor 18. Moreover, the primary voltage also initiates a flow of control current through resistor 21 and the resistor 23 with the parallel capacitor 22 in the first switching branch as well as through the resistor 30 and the resistor 27 in the second switching branch of the control circuit. The capacitor 22 is charged by the control current in the first switching branch. Moreover, due to the voltage drop on the current measuring resistor 18 of the primary current circuit, another control current flows through the voltage divider 26 and 27 connected parallel to the measuring resistor 18.

By a corresponding dimensioning of the first switching branch for the lower rotary speed range the time point of ignition is delayed due to the charge of capacitor 22. As soon as the capacitor 22 is charged to the level of trigger voltage of the control transistor 20 the latter switches over from the locked state into the current conductive state, so that the base-emitter control path of the ignition transistor 16 is short circuited. At this moment, the primary current is interrupted and a high voltage pulse is generated in the secondary winding 13*b* causing an ignition spark on spark plug 15. Simultaneously, the interruption of the primary current accelerates the increase of the primary voltage which is applied through the resistor 21 to the base of the control transistor 20. The resistor 23 which is connected parallel to the capacitor 22 is used for adjusting the time point of ignition and for discharging the capacitor 22 after the fading of the ignition operation. The primary voltage is further applied via the resistors 30 and 27 to the second switching circuit and switches over the second control transistor 24 into its conductive state so that the interruption of the primary current is accelerated.

In the lower rotary speed range of the engine, the second control transistor 24 has no effect on the determination of the ignition time point because in the rotary speed dependent R-C member 26 the ohmic resistance of resistor 28 prevails and consequently, the voltage drop across the resistor 27 is insufficient for triggering the switch-over of the transistor 24 into its current conducting state. With rotary speed and thereby with increasing frequency the total resistance of the R-C member 26 decreases, and the potential on the tap point 25 of the voltage divider increases. Moreover, since the primary current increases with increasing speed, the voltage drop on the current measuring resistor 18 increases accordingly, whereby the potential at the tapping point 25 is further increased with increasing speed. When reaching the so-called ignition jump speed at a speed of about 4500 rot. $min^{-1}$, the potential at the tap point 25 in the second switching branch reaches the triggering voltage of the second control transistor 24 earlier than the potential on capacitor 22 in the first switching branch can reach the triggering voltage of control transistor 20. Therefore, at higher rotary speeds the time point of ignition is determined by the second control transistor 24 which is switched over by the potential at the tap point 25 into the current conducting state a defined angle of rotation ahead of the first control transistor 20, thus locking the ignition transistor 16 and triggering the ignition at the advanced time point. Therefore, the ignition time adjustment characteristic line in FIG. 2 jumps from the level of curve b to the level of curve c, thus obtaining a preliminary adjustment of the ignition time point in the direction of an ignition advance. Since with increasing speed the overall resistance value of the R-C member 26 decreases, the time point of ignition according to the dotted line c' would be further adjusted in the direction early ignition. However, since this effect is frequently unfavorable for an optimum power output of the internal combustion engine, it is suppressed by the resistor 30 connected between the base of the second control transistor 24 and the collector of ignition transistor 16. Control current which up to the time point of ignition flows through the resistors 30 and 37 in the second switching branch decreases with increasing speed, thus acting against a further increase of the potential on tap point 25.

FIG. 3 illustrates a further embodiment of the ignition system in accordance with FIG. 1, whereby the structural elements which were described already in FIG. 1 are provided with the same reference numerals. The ignition transistor 16 is illustrated as a triple-Darlington power transistor with inverse diode 31. The current measuring resitor is divided into two series connected resistors 18*a* and 18*b*, whereby the tap point 32 between both resistors is connected with the emitters of the control transistors 20 and 24. To determine the ignition time point for the idling speed range, the control circuit is provided with a third control transistor 33 whose C-E switching path is connected in parallel to the corresponding switching paths of the two other control transistors 20, 24. The base of the transistor 33 is connected to connection B of the primary current circuit via a R-C member consisting of a parallel connection of a resistor 35 and a capacitor 34. The base of the control transistor 33 is also connected by means of a further resistor 36 with the collector of the ignition transistor 16. The temperature course of the control transistors 20,24 and 33 is balanced by PTC-resistors **21*a*,36*a* and 30 which connect the bases of the control transistors 20,24 and 33 with the collector of the ignition transistor 16. The PTC-resistors 21*a* and 36*a* are connected in series with resistors 21 and 36**.

In order to realize a spatially small and easy to manufacture control circuit, the PTC-rsistors **21*a*,36*a*,30, the ignition transistor 16 with its coupling resistor 19 and the inverse diode 31 as well as the series connected zener diode 17 are integrated in a first IC-building block 37. The three control transistors 20,24 and 33 are contained in another IC-building block 38. Both IC-building blocks 37 and 38 are combined in a hybride design on a substrate with the remainder of the structure elements of the control circuit and are connected via the connections A and B to the primary winding 13*a* of the magnet generator 10 of FIG. 1**.

The mode of operation of the ignition system with the control circuit illustrated in FIG. 3 essentially corresponds to the mode of operation described in FIG. 1. The third switching branch with the third control transistor 33 is used for determining the time point of ignition in the idle speed range, with respect to the exhaust gas values of the internal combustion engine. The delayed switch-over of the third control transistor 33 caused by the charge of capacitor 34 in the third switch branch follows the dash-dotted line a in FIG. 2. Since this third switching branch is connected parallel to the first switching branch, by a corresponding dimensioning of capacitor 34 and resistors 35, 36 and **36*a* the trigger voltage of the control transistor 33 during each rotation of the magnet system 11 is reached earlier than the trigger voltage of the control transistor 20 in the first switching circuit. A further delay of the ignition time point which goes beyond the apex of the current half wave in the lower speed range, is obtained by increasing the emitter potential of the control transistors 20,24 and 33 by the voltage drop across the part 18*b* of the current measuring resistor. Therefore, the time point of ignition in the idle speed range will follow the dash-dotted curve a in FIG. 2 and is determined by the third control transistor 33 whose switch-over into the current conductive state causes the blocking of the ignition transistor 16 and triggering of the ignition. Since a certain time period is required for charging the capacitors 22 and 34 in the first and third switching branch, the switch-over of the associated control transistors 20 and 33 is further delayed with increasing speed, which is recognizable by the declining branches a and b of the adjustment curve in accordance with FIG. 2. Since according to curve a the delay during the switch-over of the third control transistor 33 in the third switching branch becomes relatively large with increasing speed, the first switching branch with the control transistor 20 takes over the triggering of the ignition at a speed of about 1500 rot. min.$^{-1}$. At a speed of 4500 rot. min.$^{-1}$ the second switching branch finally takes over the ignition triggering by switching over the second control transistor 24 through the coupling to the series connected current measuring resistors 18*a* and 18*b*, and thereby a jump adjustment in the direction of early ignition is achieved. In the upper speed range an advanced adjustment according to line c' caused by the speed dependent R-C member 26, is prevented by resistor 30**.

The invention is not limited to the exemplified embodiments in accordance with FIGS. 1 and 2, since modifications in the circuitry structure are possible. However, it is essential that for realizing an abrupt preliminary adjustment of the ignition time point in the lower speed range, the time point of ignition is determined by the primary voltage in dependency on a first switching branch with a first control switch, whereby in the upper speed range the time point of ignition is triggered in dependency on the primary current. Thereby, the so-called ignition adjustment jump speed or jump speed range is defined by a frequency or speed dependent resistance of a R-C member, whereby the characteristic curve transits from the first part b realized by the first switching branch to the second part c realized by the second switching branch of the control circuit. For generating a strong voltage half wave applicable for energizing the ignition via the primary current circuit, the ignition armature of the magnet generator is mounted on the center shank of a E-shaped iron core. However, a sufficient ignition half wave is also possible with a U-shaped iron core. In an advantageous manner the entire circuit is embedded in a cup-shaped housing of the ignition armature. It is insignificant for the realisation of the invention, which end of the primary winding **13*a* is grounded. As for capacitors used in the circuit design one can use printed circuit capacitors or chip capacitors. Since with an ignition armature having an E-iron core the average voltage half wave used for the ignition is substantially stronger than the preliminary and subsequent voltage half waves of opposite polarity, the ignition system is also safe in against back-kicking the required speed range, since during the potential reversal of the weaker half waves in the reverse run or kick-back no ignition is triggered. An adjustment for the transition of the adjustment line between the individual segments a, b and c of FIG. 2 can be accomplished in that the resistors 23,27 and 35** in the three switching branches are designed as adjustable resistors.

High ignition voltages of more than 15 KV can be obtained with the invention ignition system in the idle and load operating range. A good ignition time of the adjustment characteristic curve is possible, due to the different operation of respective trigger circuits. The ignition system is back-kicking safe, despite a low idle speed. Since the control transistors 20,24, and 33 as well as the ignition transistor 16 operate in the operation, they are not influenced in their operation by amplification fluctuations. Moreover, different adjustment characteristic curves can be realised with a good temperature compensation by the independently operating switch branches.

We claim:

1. Ignition system for internal combustion engines comprising a magnet generator provided with an ignition armature cooperating with a rotary magnet system driven by an internal combustion engine to generate voltage half waves of opposite polarity, the ignition armature including a secondary winding connectable to an ignition plug and a primary winding connected to a primary current circuit, the primary current circuit comprising an electronic ignition switching element responsive to voltage half waves of one polarity and having a control electrode, a control circuit coupled to said control electrode for switching-over at an ignition time point said ignition switching element from a conductive state to a blocking state whereby an ignition voltage is induced in said secondary winding, said control circuit including a first control subcircuit provided with first timing means for triggering the switch-over of said ignition switching element at a first ignition time point, said first timing means being responsive to a frequency of said voltage half waves corresponding to a predetermined lower speed range, and a second control subcircuit provided with second timing means for triggering the switch-over of said ignition switching element at a second ignition time point which is advanced relative to said first ignition time point, said second timing means being responsive to a frequency of current half waves passing through said ignition switching element and corresponding to a predetermined upper speed range.

2. Ignition system as defined in claim 1, wherein said control circuit further includes a measuring resistor connected in series with a switching path of said ignition switching element, said first control subcircuit including a first control switching element connected to said control electrode of the ignition switching element and being activated in response to a predetermined first voltage level, said first timing means including a first voltage divider connected across the series connection of said measuring resistor and said ignition switching element and having a tap point connected to said first control switching element, a branch of said first voltage divider including a first frequency dependent R-C member preadjusted for reaching said first voltage level at said first ignition time point, said second control subcircuit including a second control switching element connected to said control electrode of the ignition switching element and being activated in response to a predetermined second voltage level, said second timing means including a second voltage divider connected across said measuring resistor and having a tap point connected to said second control switching element, a branch of said second voltage divider including a second frequency dependent R-C member preadjusted for reaching said second voltage level at said second ignition time point thus insuring an abrupt transition of timing characteristic between said lower and upper speed ranges toward a delayed or advanced ignition time point.

3. Ignition system as defined in claim 2, wherein said second voltage divider further includes a resistor connected to said tap point in parallel to said switching path of the ignition switching element.

4. Ignition system as defined in claim 3, wherein said first and second control switching elements are switching transistors whose switching paths are connected parallel to said series connection of the measuring resistor and said ignition switching element.

5. Ignition system as defined in claim 4, wherein said control circuit includes a third control subcircuit including a third control switching transistor connected parallel to said first and second control switching transistors, and a third frequency dependent timing means.

6. Ignition system as defined in claim 5, wherein said ignition switching elements is a triple Darlington transistor whose collector is connected to bases of said first, second and third switching transistors via PTC-resistors.

7. Ignition system as defined in claim 6, wherein said PTC-resistors together with said triple Darlington transistor are contained in a common IC-building block, and said three control switching transistors being contained in another common IC-building block.

* * * * *